United States Patent [19]

Solomon

[11] 4,325,595

[45] Apr. 20, 1982

[54] CARD FILE

[75] Inventor: Jack Solomon, Long Beach, N.Y.

[73] Assignee: Oxford Pendaflex Corp., Garden City, N.Y.

[21] Appl. No.: 963,190

[22] Filed: Nov. 24, 1978

[51] Int. Cl.[3] ..... A47B 63/00; B65D 43/24

[52] U.S. Cl. ..... 312/183; 312/185; 312/271; 312/320; 220/335; 206/45.13; 206/45.18

[58] Field of Search ..... 312/183, 185, 188, 261, 312/262, 271, 281, 294, 320, DIG. 33, 284; 206/45.13, 45.18, 425, 804; 220/335

[56] References Cited

U.S. PATENT DOCUMENTS

| | | | |
|---|---|---|---|
| 298,450 | 5/1884 | Colton | 312/183 |
| 1,014,598 | 1/1912 | Hunter | 312/183 |
| 1,140,061 | 5/1915 | Pike | 206/45.18 |
| 1,142,971 | 6/1915 | Kurtz | 312/271 |
| 1,234,025 | 7/1917 | Hick | 312/294 |
| 1,338,833 | 5/1920 | Kornsweet | 312/281 |
| 1,381,361 | 6/1921 | Studer | 312/185 |
| 2,409,926 | 10/1946 | Bloom | 206/45.13 |
| 2,430,707 | 11/1947 | Cahn | 206/804 |
| 2,622,955 | 12/1952 | Kramer | 206/45.13 |
| 2,680,512 | 6/1954 | Young | 206/45.13 |
| 3,086,645 | 4/1963 | Yount | 206/45.13 |
| 3,240,375 | 3/1966 | Burrows | 220/335 |
| 3,253,871 | 5/1966 | Karper | 312/284 |
| 3,985,409 | 10/1976 | Kneier | 312/271 |
| 4,091,918 | 5/1978 | Soulakis et al. | 312/271 |
| 4,148,411 | 4/1979 | Hodge et al. | 220/335 |

*Primary Examiner*—Victor N. Sakran
*Attorney, Agent, or Firm*—Darby & Darby

[57] ABSTRACT

A device for storing index or file cards in which one wall of the device is pivotally mounted to the compartment containing the cards is disclosed. In addition, a cover hingedly mounted to the compartment serves to restrict travel of the pivotally mounted wall when the cover is lifted.

11 Claims, 6 Drawing Figures

CARD FILE

BACKGROUND OF THE INVENTION

The present invention relates generally to card storage and viewing equipment, and specifically concerns a device for storing index or file cards. The device of the present invention has the general appearance of ordinary devices for storing index or file cards when it is closed. Such devices are well known in the prior art and ordinarily consist of a box-shaped container having an open top and a lid hingeably connected to the container to close the top. The cards are inserted into the container so that the top of the cards can be seen when the lid is opened. This design has several distinct disadvantages. It is difficult to view more than the upper portion of each card. Additionally, there is no room to insert one's fingers for the purpose of flipping through the cards or to remove an individual card from the box. The arrangement is particularly cumbersome when the box is full or nearly so.

A container which elevates a stack of index cards for display purposes is described in U.S. Pat. No. 4,091,918, which issued to G. Soulakis and C. Mandala on May 30, 1978. The device of that patent comprises a carrier which fits into a box containing the cards and on which the cards rest. When the lid of the box is opened, the carrier is lifted up and back towards the rear of the box. At the same time, a plate which is hingedly connected to the carrier and fixedly connected to the front of the box moves from its upright position to an angular position with respect to the carrier. When the lid is fully opened, the carrier is at an angle with respect to the horizontal—its rear end being higher than its front end. In this position, the plate serves as a stop against which the cards may rest when they are flipped forward. However, this device is somewhat cumbersome and relatively expensive and difficult to manufacture as compared to many of the prior art card storage devices.

The device of the present invention obviates the disadvantages of the prior art, and particularly the disadvantages of the device illustrated in U.S. Pat. No. 4,091,918.

It is an object of the present invention to provide a card file which allows the cards to be easily viewed while being retained within the device.

It is a further object of the invention to provide a card file which allows an individual card to be easily removed from and then reinserted into the device.

It is a still further object of the present invention to provide a card file which is lightweight and easy to assemble.

It is a still further object of the present invention to provide a card file which is relatively inexpensive to manufacture as compared with similar devices found in the prior art.

An illustrative embodiment demonstrating objects and features of the present invention includes a box-shaped container of unique construction. One wall of the device is pivotally mounted to the compartment in which the cards are contained. In addition, a cover is hingedly mounted to the compartment. The cover acts to restrict travel of the pivotally mounted wall when the cover is opened.

When the cover is in a closed position, the pivotally mounted wall stands upright and the device has the general appearance of ordinary devices for holding index cards, as have been described. When the cover is opened, the pivotally mounted wall falls back, permitting the cards to fan out. This allows easy access to and viewing of the cards, even when the compartment containing the cards is extremely full.

Other objects, features and advantages of the present invention may be understood more completely by the following detailed description in connection with the accompanying drawings, in which.

DETAILED DESCRIPTION OF THE PREFERRED EMBODIMENT

Figure 1:
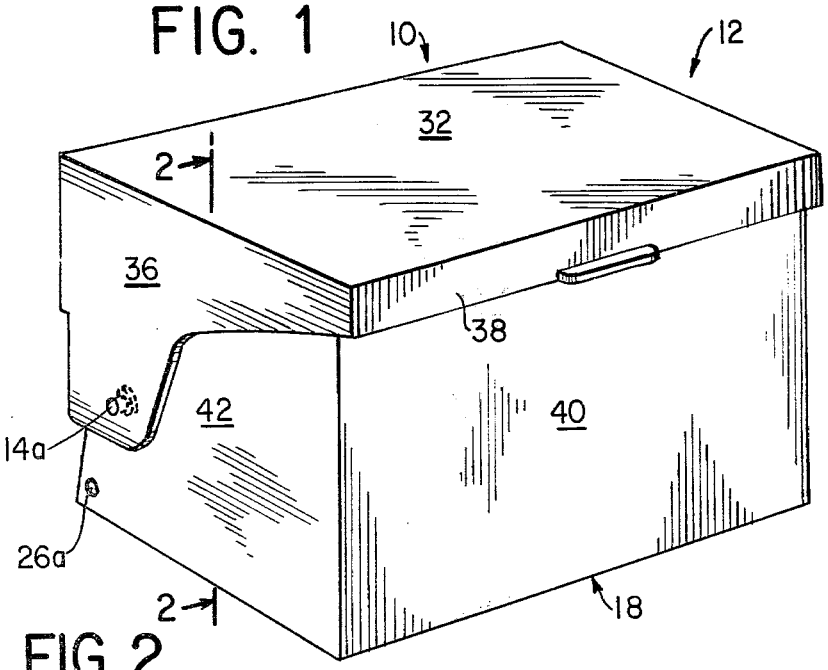
FIG. 1 is a perspective view of a container in accordance with the present invention.
Figure 6:
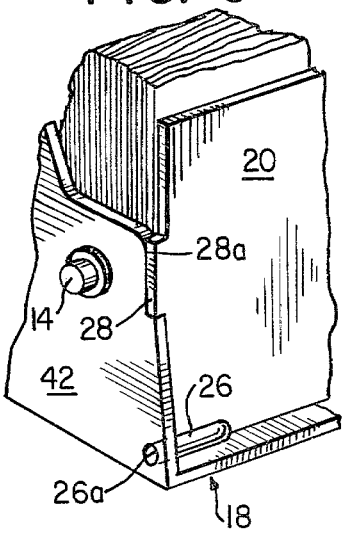
FIG. 6 is a partial perspective view of the rear of the container illustrated in FIG. 1.
Figure 2:
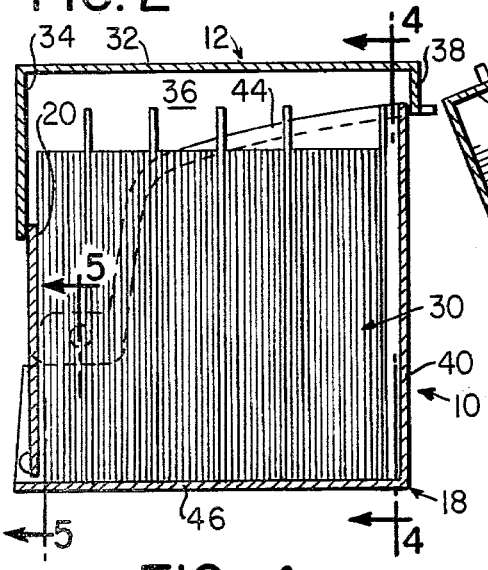
FIG. 2 is a sectional view taken substantially along contour 2—2 of FIG. 1.

Referring now to the detailed drawings, the invention is directed to a construction for a container 10 for storing index cards 30. Compartment 18 of container 10 has a front wall 40, two side walls 42 and 44, and a bottom wall 46. Wall 20 is pivotally mounted to compartment 18 and forms the rear wall of the compartment. In addition, container 10 includes a cover 12 which is also hingedly mounted to compartment 18.

Wall 20 includes pivot pin 26 and stop 28 on at least one side and preferably on two opposing sides of the wall. Pivot pin 26 extends outwardly along a bottom edge of wall 20 and protrudes past the periphery of the wall along a side edge. Pin 26 is preferably dowel-shaped and fits into holes **26*a* in sidewalls 42 and 44, as will be explained more fully below. Any suitable means may be used to pivot wall 20 with respect to side walls 42 and 44**.

Stop 28 consists of an outward projection of the periphery of wall 20 along a side edge, which may be the same side edge past which pin 26 protrudes. It is only necessary for stop 28 to be positioned along one side edge of wall 20 in order for it to serve its intended purpose, but additional stops may be used for the sake of uniformity or ease of manufacture.

Cover 12 is made up of cover top 32, side walls 36 which extends downwardly from the cover top, a front wall 38 and at back wall 34 which form a closed perimeter for the cover. Thus, in the preferred embodiment, cover top 32 is rectangular in shape and walls 34, 36 and 38 extend downwardly therefrom. Cover 12 includes a hole **14*a* in each of the side walls 36 and an indentation (not shown) on the interior-facing side of front wall 40**.

In the preferred embodiment bottom wall 46 is rectangular in shape and three side walls extend upwardly therefrom to form compartment 18. The surface area of bottom wall 46 is slightly smaller than the surface area of cover top 32 so that the cover top 32 can close over the compartment 18.

Each compartment side wall 42 and 44 has a pivot hole **26*a* located near the lower corner of the wall adjacent the open side. In addition, a dowel-shaped hinge pin 14 extends outwardly from the exterior surface of each of the compartment side walls 42 and 44. An indentation 28A is formed along the periphery of each of the side walls 42 and 44 adjacent the open side of the compartment for the purpose of cooperating with corresponding stops 28 on wall 20**.

In use, the pivot pins 26 which protrude past the periphery of wall 20 fit into pivot holes 26*a* in each of the compartment side walls 42 and 44. Stops 28 on wall 20 are aligned with the indentations 28A along the periphery of each of the compartment side walls. These stops prevent wall 20 from falling forwardly into the interior of compartment 18 while allowing container 10 to be closed tightly.

The hinge pins 14 on each of the compartment side walls 42 and 44 fit into holes 14*a* on each of the cover side walls 36. When cover 12 is closed, the indentation on the interior surface of front wall 34 fits over the protrusion on compartment front wall 40, locking the cover in a closed position. This retains wall 20 in an upright position and maintains the compartment in a tightly closed position.

Figure 3:
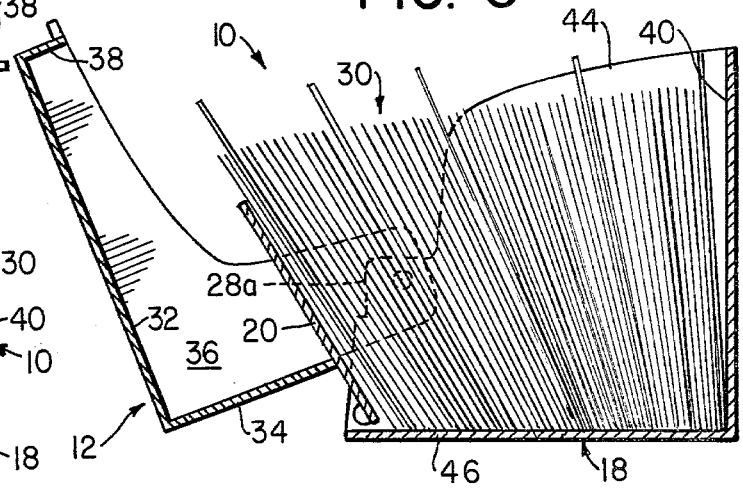
FIG. 3 is a side plan view showing a container in accordance with the present invention.
Figure 4:
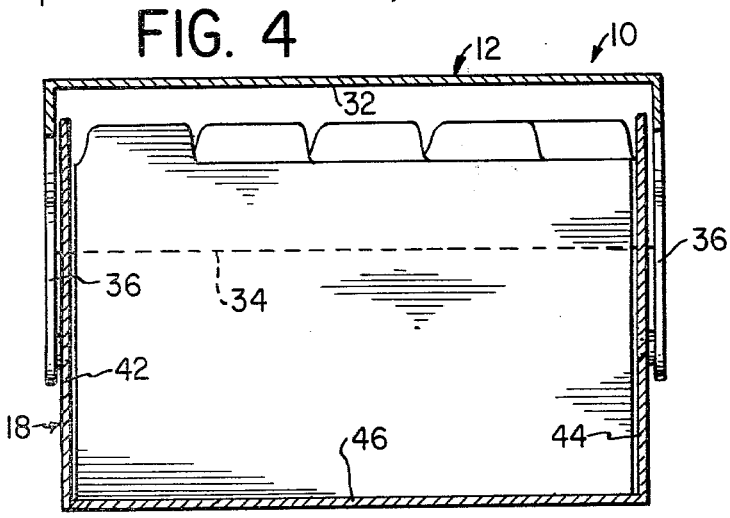
FIG. 4 is a sectional view taken substantially along contour 4—4 of FIG. 2.
Figure 5:
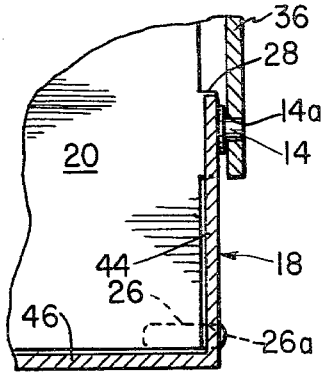
FIG. 5 is a sectional view taken substantially along contour 5—5 of FIG. 2.

When cover 12 is opened, wall 20 pivots backwardly, permitting cards 30 to fan out. As illustrated in FIG. 3, when card file 10 is on a flat surface, travel circumscribing wall 34 limits the backward pivotal movement of wall 20 to some predefined maximum rotation determined by the length of wall 34.

Although the invention has been described in terms of a specific embodiment, it will be appreciated by one skilled in the art that other embodiments in accordance with the present invention may be used. For example, the positions of pivoting wall 20 and compartment front wall 40 could be reversed. The compartment would lock in the same manner as has already been described, but the cards would fan forwardly when cover 12 was opened. Also, the compartment rear wall and the cover could be pivotally mounted to the bottom wall of the compartment rather than to the compartment side walls. It will also be appreciated that the card file of this invention may be made of any suitable material such as plastic, metal, wood or the like and may be made in any suitable size.

What is claimed as new and desired to be secured by Letters Patent of the United States is set out in the accompanying claims:

1. In an index or file card storage device of the type having a compartment including a bottom wall, two side walls and a front wall all extending vertically and rigidly therefrom, the improvement comprising:

a rear wall mounted near said bottom wall for rearward pivotal movement away from said vertically extending walls;

cover means mounted to at least one of said vertically extending walls for rearward pivotal movement from a closed position in which said cover substantially covers the uppermost ends of said vertically extending walls, said cover means having a depending member at its rear; and travel circumscribing means disposed in a fixed position on said depending member of said cover means and contacting said rear wall for limiting the rearward travel of said rear wall, said travel circumscribing means maintaining said rear wall in an upright position when said cover means is in said closed position but permitting increased rearward pivoting of said rear wall as said cover is pivoted away from said closed position.

2. The improvement recited in claim 1, said rear wall being pivotally mounted to said compartment side walls.

3. The improvement recited in claim 2, said rear wall including a pair of pins projecting laterally outwardly therefrom adjacent the bottom edge of said rear walls, said pins being positioned within corresponding cavities in said compartment side walls so as to permit said rear wall to pivot rearwardly with respect to said front wall.

4. The improvement recited in claims 2, 3 or 1 further comprising stopping means on said rear wall to prevent said rear wall from moving forwardly with respect to said front wall when said cover means are in a closed position.

5. The improvement recited in claim 4, said stopping means comprising protuberances on said rear wall extending laterally past the edges of said compartment side walls.

6. The improvement recited in claim 1, said cover means comprising a top wall with a rear wall, a pair of side walls and a front wall extending vertically and rigidly therefrom, said cover side walls being pivotally mounted to said compartment side walls and extending over a portion of said side walls, said cover front wall extending over a portion of the compartment front wall and said cover rear wall extending over a portion of said compartment rear wall when said cover is in a closed position in order to maintain said pivotally mounted compartment rear wall in an upright or vertical position when said cover is closed.

7. The improvement recited in claim 6, said cover rear wall engaging another portion of said compartment rear wall when said cover is in an opened position in order to limit the rearward travel of said pivotally mounted compartment rear wall when said cover is opened.

8. The improvement recited in claim 1, further comprising means for locking or maintaining said cover in a closed position.

9. The improvement recited in claim 8, said locking means comprising a protrusion on said compartment front wall outer surface and a corresponding indentation on said cover front wall inner surface such that a force is required to disengage said protrusion from said indentation.

10. A container for storing flat objects in a substantially vertical position, said container including a compartment having a bottom wall and an open top and back, but being otherwise closed, and further comprising:

a rear wall mounted near said bottom wall for pivotal movement with respect to said compartment, said rear wall closing said open back when in a substantially vertical position;

a cover mounted to said compartment at a pivot point near said open back for pivotal movement with respect to said compartment, said cover pivoting rearwardly from a closed position in which said open top is substantially covered to an open position in which said open top is exposed, said cover means having a depending member at its rear; and a travel circumscribing portion disposed in a fixed position on said depending member of said cover substantially in the plane of said open back when said cover is in its closed position and intermediate said pivot point and the top of said cover, said travel circumscribing portion being in continuous contact with said rear wall under normal operation, whereby said rear wall is retained in a substantially vertical position when said cover is in its closed position and is progressively rearwardly inclined as said cover is pivoted to its open position.

11. The improvement recited in claim 10, said moving means comprising said cover rear wall which engages a portion of said compartment rear wall and pivots said rear wall forwardly with respect to the compartment front wall as the cover is closed until said compartment rear wall reaches a vertical or upright position which corresponds with said cover being in a closed position.

* * * * *